US011027293B2

(12) United States Patent
Votteler et al.

(10) Patent No.: US 11,027,293 B2
(45) Date of Patent: Jun. 8, 2021

(54) NOZZLE FOR DISPENSING SYSTEM

(71) Applicant: Diversey, Inc., Sturtevant, WI (US)

(72) Inventors: Robert Votteler, Grünstadt (DE); Gerd Klimmeck, Krichheimbolanden (DE); Sebastian Rohacz, Metzingen-Neuhausen (DE)

(73) Assignee: Diversey, Inc., Fort Mill, SC (US)

( * ) Notice: Subject to any disclaimer, the term of this patent is extended or adjusted under 35 U.S.C. 154(b) by 922 days.

(21) Appl. No.: 15/022,410

(22) PCT Filed: Sep. 16, 2014

(86) PCT No.: PCT/US2014/055935
§ 371 (c)(1),
(2) Date: Mar. 16, 2016

(87) PCT Pub. No.: WO2015/039129
PCT Pub. Date: Mar. 19, 2015

(65) Prior Publication Data

US 2016/0228890 A1 Aug. 11, 2016

Related U.S. Application Data

(60) Provisional application No. 61/878,570, filed on Sep. 16, 2013.

(51) Int. Cl.
*B05B 1/30* (2006.01)
*B05B 1/26* (2006.01)
*B05B 1/04* (2006.01)

(52) U.S. Cl.
CPC ..... *B05B 1/3013* (2013.01); *B05B 1/265* (2013.01); *B05B 1/267* (2013.01); *B05B 1/306* (2013.01);
(Continued)

(58) Field of Classification Search
CPC ..... B05B 1/3013; B05B 1/265; B05B 1/267; B05B 1/3033; B05B 1/306; B05B 1/3066
(Continued)

(56) References Cited

U.S. PATENT DOCUMENTS 2,237,842 A * 4/1941 Reynolds ..... B05B 7/04 239/412
2,795,460 A 6/1957 Bletcher et al.
(Continued)

FOREIGN PATENT DOCUMENTS

DE 102007054673 5/2009
DE 102010049053 4/2012
(Continued)

OTHER PUBLICATIONS

Chinese Office Action for Application No. 201480056904.4 with English Translation dated Apr. 13, 2017 (25 pages).
(Continued)

*Primary Examiner* — Chee-Chong Lee
(74) *Attorney, Agent, or Firm* — Michael Best & Friedrich LLP

(57) ABSTRACT

A fluid dispensing nozzle includes a housing including an outlet to discharge fluid to a surrounding environment. The fluid dispensing nozzle also includes a nozzle insert disposed in the housing and including an inlet in fluid communication with a source of fluid to receive a fluid flow. The nozzle insert includes an outlet orifice in fluid communication with the outlet to direct fluid from the inlet toward the outlet. The nozzle insert is selectively movable relative to the housing between a first position in which fluid is discharged through the outlet at a first flow rate and a second position in which the fluid is discharged through the outlet at a second flow rate larger than the first flow rate. The nozzle insert is movable between the first position and the
(Continued)

second position independent of the pressure of fluid at the inlet.

24 Claims, 7 Drawing Sheets

(52) U.S. Cl.
CPC ..... *B05B 1/3033* (2013.01); *B05B 1/3066* (2013.01); *B05B 1/042* (2013.01)

(58) Field of Classification Search
USPC ..... 239/11
See application file for complete search history.

(56) References Cited

U.S. PATENT DOCUMENTS

| | | | | | |
|---|---|---|---|---|---|
| 2,985,385 | A | * | 5/1961 | Bowers | B05B 1/3026 239/103 |
| 3,111,273 | A | * | 11/1963 | Mei | B05B 1/1663 239/343 |
| 3,514,042 | A | * | 5/1970 | Freed | B05B 1/1681 239/438 |
| 3,632,047 | A | | 1/1972 | Ghougasian | |
| 3,670,967 | A | * | 6/1972 | Fahlin | B05B 9/01 239/412 |
| 3,986,673 | A | | 10/1976 | Beck | |
| 4,117,979 | A | * | 10/1978 | Lagarelli | B05B 1/1681 239/381 |
| 4,221,337 | A | * | 9/1980 | Shames | B05B 1/1663 137/625.48 |
| 4,265,405 | A | * | 5/1981 | Takagi | B05B 1/1609 239/440 |
| 4,277,030 | A | | 7/1981 | Hechler, IV | |
| 4,618,100 | A | | 10/1986 | White et al. | |
| 4,655,394 | A | | 4/1987 | Ferrazza et al. | |
| 5,129,549 | A | | 7/1992 | Austin | |
| 5,156,336 | A | | 10/1992 | Hammond et al. | |
| 5,794,825 | A | | 8/1998 | Gordon et al. | |
| 5,806,770 | A | | 9/1998 | Wang | |
| 6,220,528 | B1 | | 4/2001 | Cooke et al. | |
| 6,402,052 | B1 | | 6/2002 | Murawa | |
| 7,007,865 | B2 | | 3/2006 | Dodd | |
| 8,640,980 | B2 | | 2/2014 | Nordstrom | |
| 8,807,462 | B2 | | 8/2014 | Tix et al. | |
| 2005/0035224 | A1 | | 2/2005 | Dodd | |
| 2005/0236496 | A1 | | 10/2005 | Lasebnick | |
| 2007/0267523 | A1 | | 11/2007 | Roumanis | |
| 2009/0095770 | A1 | | 4/2009 | Newton et al. | |
| 2011/0049267 | A1 | | 3/2011 | Tix et al. | |
| 2011/0101132 | A1 | | 5/2011 | Nordstrom | |

FOREIGN PATENT DOCUMENTS

| | | |
|---|---|---|
| EP | 1091117 | 4/2001 |
| EP | 2415533 | 2/2012 |
| GB | 2093373 | 9/1982 |
| GB | 2298808 | 9/1996 |
| WO | 2010091330 | 8/2010 |

OTHER PUBLICATIONS

International Search Report, PCT/US2014/055935, dated Dec. 31, 2014.
Written Opinion, PCT/US2014/055935, dated Dec. 31, 2014.
Extended European Search Report for Application No. 14843520.9 dated Mar. 28, 2017 (8 pages).
European Patent Office Examination Report for Application No. 14843520.9 dated Jul. 30, 2019, 6 pages.

* cited by examiner

NOZZLE FOR DISPENSING SYSTEM

CROSS-REFERENCE TO RELATED APPLICATIONS

This application is a national stage filing under 35 U.S.C. § 371 of International Application No. PCT/US2014/055935, filed Sep. 16, 2014, which claims priority to U.S. Provisional Application No. 61/878,570, filed Sep. 16, 2013, the entire contents of both applications are incorporated herein by reference.

BACKGROUND

Existing nozzles are used to selectively control the flow of a fluid, such as water, chemicals, beverages, and the like, to dispense the fluid at a desired flow rate. Many of these nozzles have a nozzle insert that can adjust the flow rate through the nozzle as a function of the pressure of the fluid entering the nozzle. For example, some nozzles have a low flow operating mode when the entering fluid is supplied at a first pressure or velocity and a high flow operating mode when the entering fluid is supplied at a second, higher pressure or velocity. In these nozzles, the higher flow rate can only be achieved by increasing the fluid pressure or velocity of fluid entering the nozzle.

SUMMARY

The present invention relates to a fluid dispensing nozzle that controls flow of a fluid through the nozzle independent of the pressure of the fluid entering the nozzle.

The invention provides, in one aspect, a fluid dispensing nozzle including a housing including an outlet to discharge fluid to a surrounding environment. The fluid dispensing nozzle also includes a nozzle insert disposed in the housing and including an inlet in fluid communication with a source of fluid to receive a fluid flow. The nozzle insert includes an outlet orifice in fluid communication with the outlet to direct fluid from the inlet toward the outlet. The nozzle insert is selectively movable relative to the housing between a first position in which fluid is discharged through the outlet at a first flow rate and a second position in which the fluid is discharged through the outlet at a second flow rate larger than the first flow rate. The nozzle insert is movable between the first position and the second position independent of the pressure of fluid at the inlet.

The invention provides, in another aspect, a fluid dispensing nozzle including a housing defining an outlet and a nozzle insert disposed in the housing. The nozzle insert is selectively movable relative to the housing between a first position and a second position. The nozzle insert includes an inlet positioned to receive a flow of fluid from a fluid source, a first outlet orifice to discharge fluid from the nozzle insert, and a second outlet orifice spaced from the first outlet orifice to discharge fluid from the nozzle insert. Fluid is discharged through the first outlet orifice when the nozzle insert is in the first position, and fluid is discharged through the first outlet orifice and the second outlet orifice when the nozzle insert is in the second position.

The invention provides, in another aspect, a fluid dispensing system including a fluid source, a pipeline coupled to the fluid source and extending from the fluid source to convey fluid from the fluid source, and a nozzle coupled to the pipeline. The nozzle includes a housing coupled to the pipeline and including an outlet to discharge fluid from the pipeline to a surrounding environment, and a nozzle insert disposed in the housing and defining an outlet orifice. The nozzle insert is selectively movable relative to the housing between a first position in which fluid is discharged through the nozzle insert and the outlet at a first flow rate and a second position in which fluid is discharged through the nozzle insert and the outlet at a second flow rate larger than the first flow rate. The housing and the nozzle insert cooperatively define a gap, and the housing includes a port in communication with the gap and further adapted to be in communication with a source of actuating fluid to selectively vary the position of the nozzle insert within the housing to adjust the flow rate of fluid discharged from the outlet.

The invention provides, in another aspect, a method of changing a flow rate of a fluid through a dispensing nozzle. The method includes directing a fluid into an inlet of a nozzle insert supported by a housing, discharging fluid through the nozzle insert along a first flow path, and dispensing fluid from the nozzle at a first flow rate. The method further includes selectively adjusting the nozzle insert relative to the housing, discharging fluid through the nozzle insert along the first flow path and a second flow path in response to movement of the nozzle insert relative to the housing, and dispensing fluid from the nozzle at a second flow rate different from the first flow rate independent of the pressure of fluid entering the nozzle.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
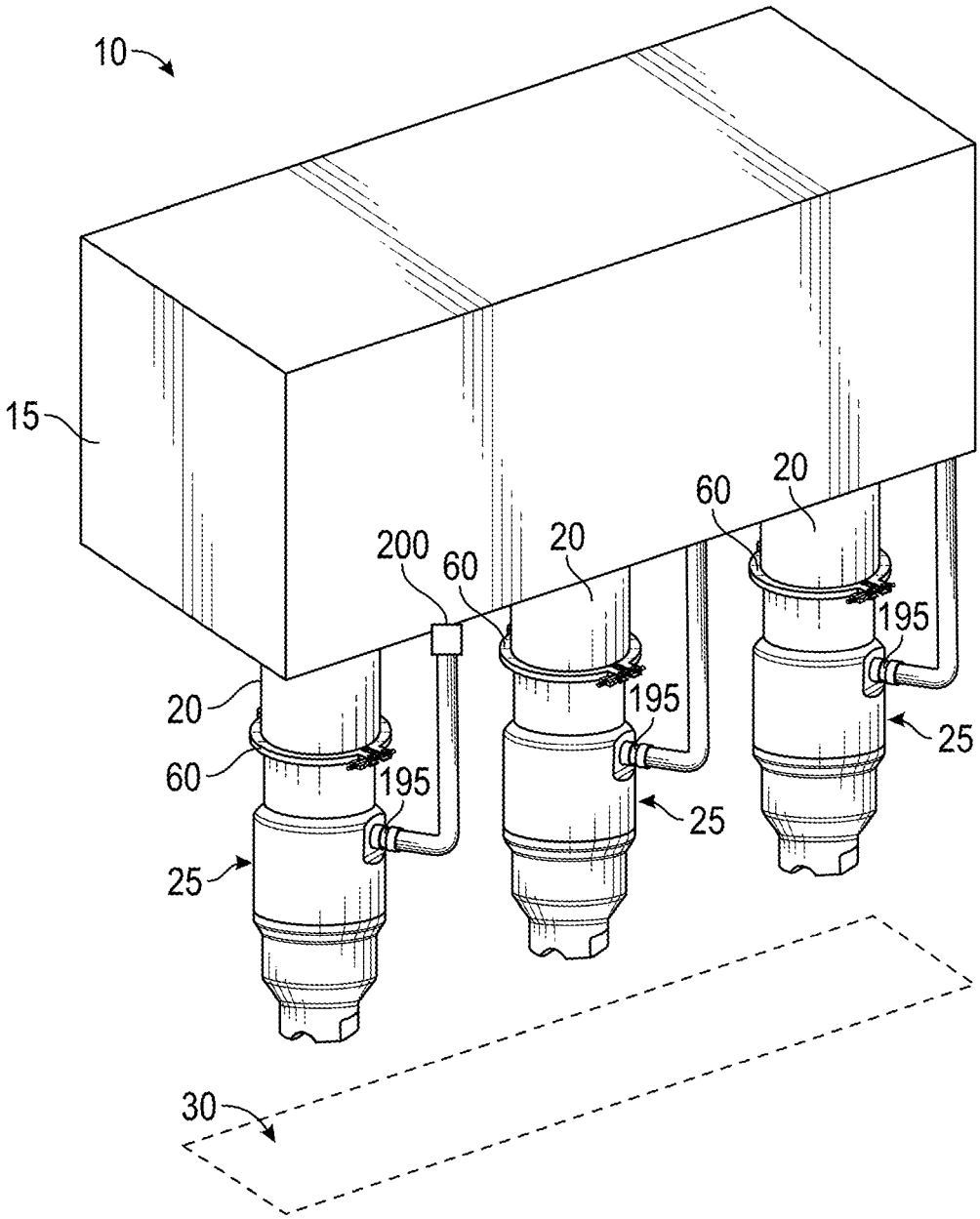
FIG. 1 is a perspective view of a fluid dispensing system including a plurality of nozzles embodying the invention.

FIG. 1 illustrates a fluid dispensing system 10 including a fluid source 15, a plurality of pipelines 20 for conveying a fluid from the fluid source 15, and a plurality of nozzles 25 that are coupled to the pipelines 20 to discharge fluid from the system 10 into a surrounding environment 30 (e.g., a tank, reservoir, container, assembly line, container filling line, etc.). The fluid may include, for example, water, foam, chemicals (e.g., cleaning products, sanitizing solutions, etc.), or beverages. Other fluids can also be directed through the system, and should be considered herein.

Figure 2:
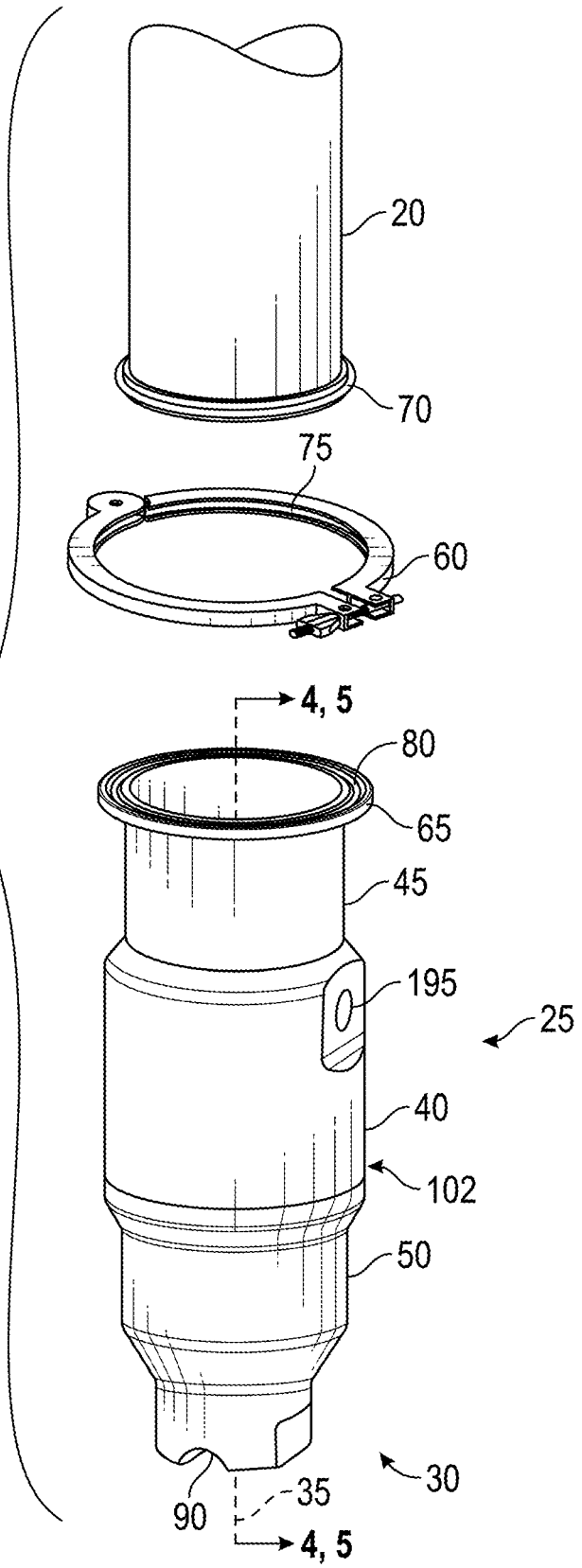
FIG. 2 is a perspective view of a portion of the fluid dispensing system and one of the nozzles of FIG. 1.
Figure 3:
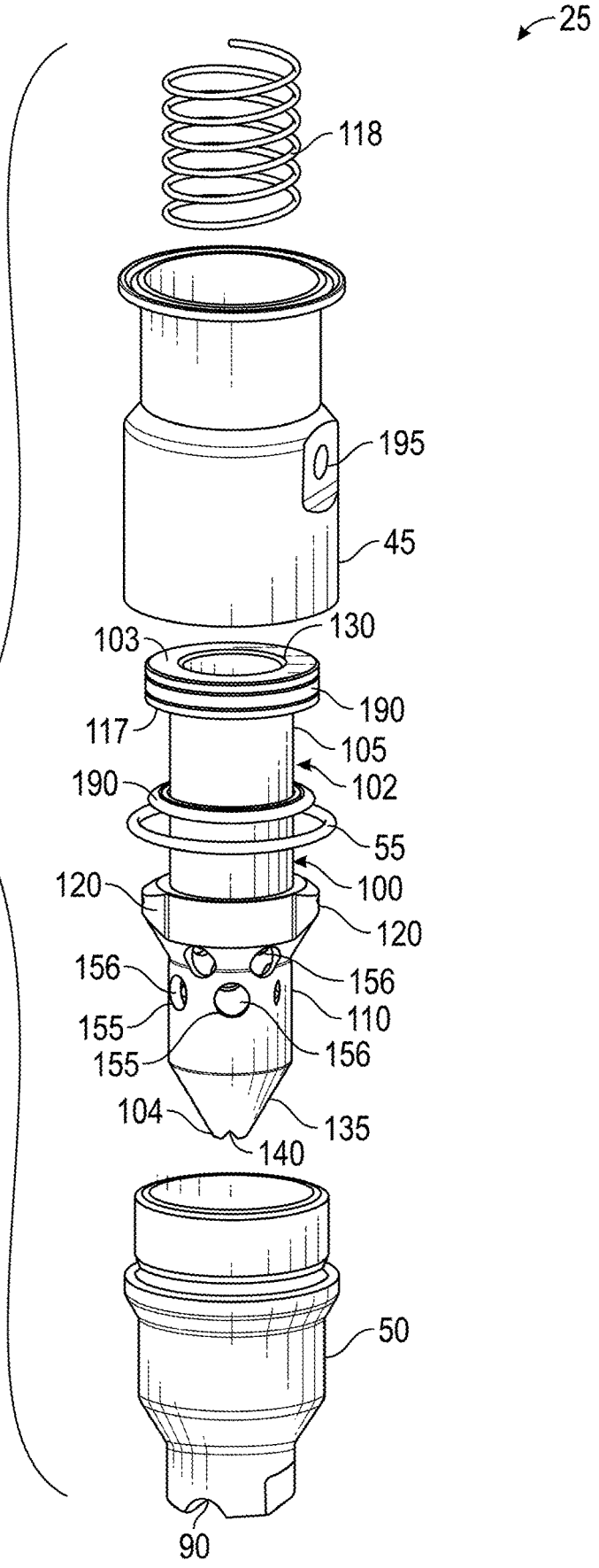
FIG. 3 is an exploded view of the fluid dispensing nozzle of FIG. 2 including a housing and a nozzle insert.

Referring to FIGS. 2 and 3, the nozzle 25 defines a longitudinal axis 35 and includes a housing 40 that has a first or upper housing portion 45 and a second or lower housing portion 50. An O-ring 55 is located at an interface between the upper and lower housing portions 45, 50 to create a substantially fluid-tight seal between the housing portions 45, 50 (FIG. 3). In the illustrated embodiment, the nozzle 25 is removably coupled to one of the pipelines 20 of the fluid dispensing system 10 by a clamp 60 (e.g., a tri-clamp), although other pipe connections can be used (e.g., threaded connections, bolted connections, etc.). The upper housing portion 45 and the pipeline 20 include ferruled ends 65, 70 that encapsulated by the clamp 60 such that the ends 65, 70 are disposed in an inner circumferential groove 75 of the clamp 60 to secure the pipeline 20 and the nozzle 25 to each other. An O-ring or gasket 80 is positioned between the ferruled ends 65, 70 to provide a substantially fluid-tight seal.

Figure 5:
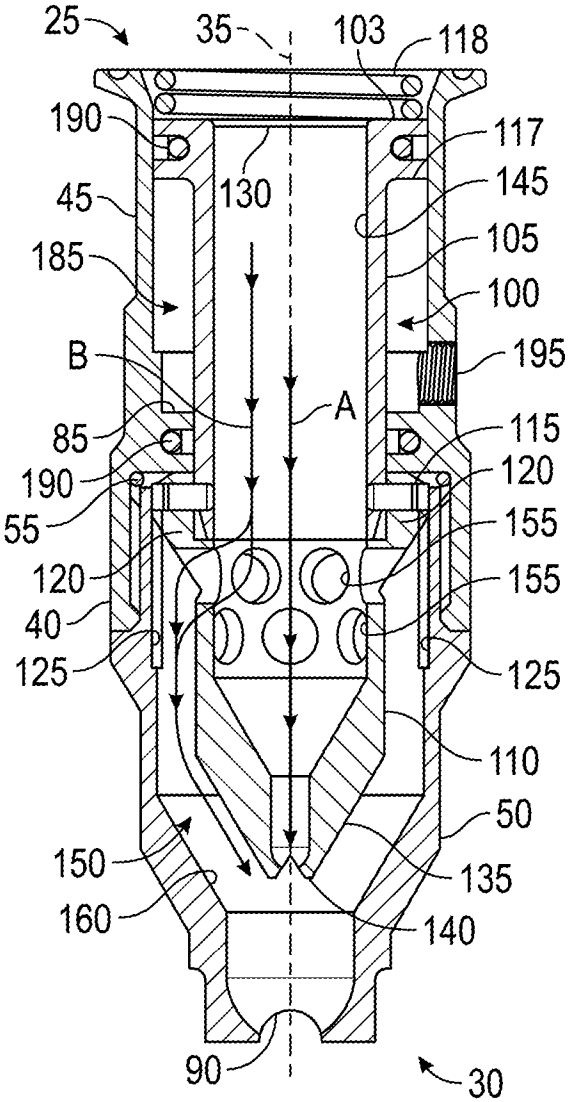
FIG. 5 is a cross-sectional view of the fluid dispensing nozzle of FIG. 2, taken along line 5-5 and illustrating the nozzle in a high flow state.
Figure 4:
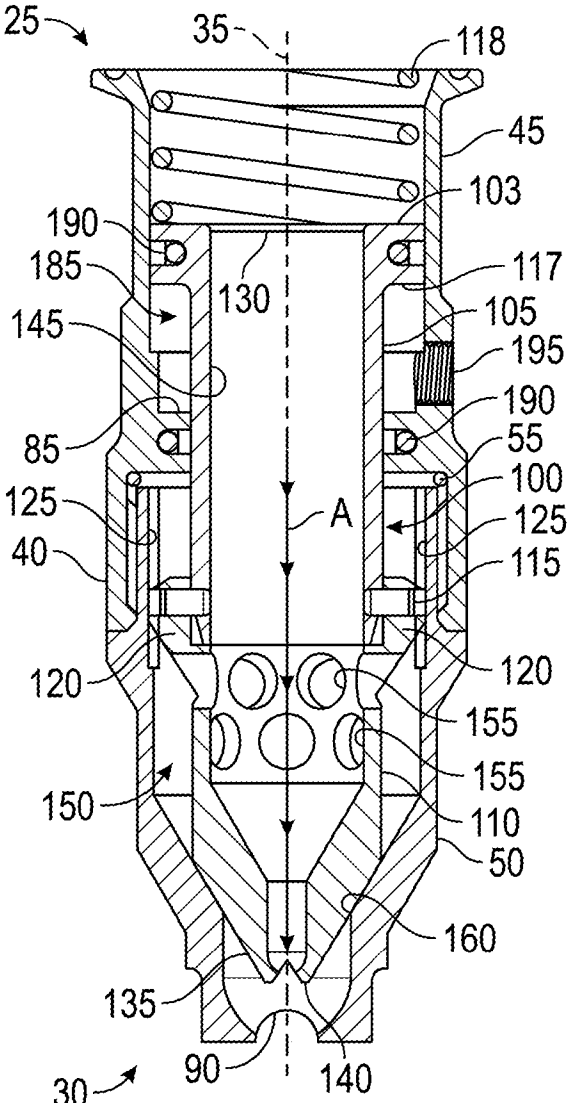
FIG. 4 is a cross-sectional view of the fluid dispensing nozzle of FIG. 2, taken along line 4-4 and illustrating the nozzle in a low flow state.

The upper housing portion 45 is connected to the pipeline 20 to receive a flow of fluid from the fluid source 15. As shown in FIGS. 4 and 5, the upper housing portion 45 includes an annular inner wall or rim 85 spaced from the opposite ends of the upper housing portion 45. When the housing 40 is assembled, the lower housing portion 50 is attached to the upper housing portion 45 (e.g., via threaded engagement, snap-fit engagement, etc.). The lower housing portion 50 includes an outlet 90 to discharge the fluid to the surrounding environment 30. The outlet 90 can have a variety of geometries to produce a particular spray pattern.

With reference to FIGS. 3-5, the nozzle 25 further includes a nozzle insert 100 disposed in the housing 40 to selectively control the flow of fluid from the nozzle 25. That is, the nozzle insert 100 primarily controls the rate at which fluid is discharged through the outlet 90. The nozzle insert 100 includes an elongated body 102 that is encapsulated by the upper and lower housing portions 45, 50, and that has a first end 103 and a second end 104 opposite the first end 103. In the illustrated embodiment, a generally cylindrical first or upper section 105 extends from the first end 103 toward a central section of the nozzle insert 100. A second or lower section 110 extends from the central section toward the second end 104. The upper and lower sections 105, 110 are coupled together by a snap ring 115 (shown in FIGS. 4 and 5), although in other embodiments, the sections 105, 110 can be coupled together by a cotter pin, threaded connection, or any other suitable arrangement. Alternatively, the upper and lower sections 105, 110 can be integrally formed or welded together as a single piece.

The upper section 105 includes an annular flange 117 disposed adjacent the inlet 130. The illustrated nozzle 25 includes a spring or bias element 118 (e.g., coil spring) that acts on the flange 117 to bias the nozzle insert 100 toward the first position. In some embodiments, the bias element 118 can be omitted. In these embodiments, the nozzle insert 100 can be biased toward the first position by fluid flow through the nozzle 25 that impinges on the flange 117 and the relatively small amount of fluid flow resistance provided by the tapered shape of the nozzle insert 100.

The lower section 110 of the nozzle insert 100 includes a pair of projections 120 that extend outward from the cylindrical bore 105 between the ends 103, 104 of the nozzle insert 100. As illustrated, the projections extend substantially radially-outward from the nozzle insert body and are slidable relative to the lower housing portion 110 within grooves 125 to prevent rotation of the nozzle insert 100 relative to the housing 40.

Referring to FIGS. 4 and 5, the nozzle insert 100 is selectively movable relative to the housing 40 between a first position (FIG. 4) corresponding to a relatively low flow state of the nozzle 25 and a second position (FIG. 5) corresponding to a higher flow state of the nozzle 25. In the illustrated embodiment, the nozzle insert 100 is slidable relative to the housing 40 so that the nozzle insert 100 slides or otherwise moves along the longitudinal axis 35.

The first end 103 of the nozzle insert 100 defines an inlet 130 in fluid communication with the fluid source 15 to receive fluid, and the second end 104 defines a first outlet orifice 140 in fluid communication with the outlet 90 to direct fluid from the inlet 130 toward the outlet 90. As used herein, the phrase "fluid communication" refers to the ability of fluids to be transported between two spaces. An elongated central bore 145 extends longitudinally through the body 102 of the nozzle insert 100 from the inlet 130 to the first outlet orifice 140 to define a first flow path A between the inlet 130 and the first outlet orifice 140. The area between the lower portion 50 of the housing 40 and the second end 104 of the nozzle insert 100 defines an outlet chamber 150 adjacent the outlet 90. As illustrated, the outlet chamber 150 surrounds the lower section 110 of the nozzle insert 100.

With reference to FIG. 4, when the nozzle insert 100 is in the first position, a tapered end portion 135 disposed adjacent the second end 104 of the nozzle insert 100 bears against an interior wall or seat 160 of the lower housing portion 50 to form a seal that prevents fluid in the outlet chamber 150 from being discharged through the outlet 90. As such, all of the fluid flowing through the nozzle insert 100 must flow through the relatively restrictive outlet orifice 140 along the first flow path A. In the illustrated embodiment, this low flow state provides a fluid flow rate through the nozzle 25 between approximately 3 liters per minute and approximately 15 liters per minute. In some embodiments, the nozzle 25 can be constructed to provide similar or other flow rates in the low flow state to suit a particular application. In addition, the outlet orifice 140 of the nozzle insert 100 can be plugged or omitted such there is no fluid flow through the nozzle 25 in the low flow state.

The nozzle insert 100 also includes a second outlet orifice 155 that is selectively in fluid communication with the chamber 150 and the outlet 90. With reference to FIGS. 4 and 5, the second outlet orifice 155 is defined by a plurality of openings 156 extending through the body 102 of the nozzle insert 100. When the nozzle 25 is in the high flow state, fluid flows along a path B through the nozzle insert 100 from the inlet 130, through the openings 156, and toward the outlet 90, where fluid flowing along flow paths A, B mix downstream of the first outlet orifice 140. In some embodiments, fluid flows along path B without also flowing along path A when the nozzle insert 100 is in the second position. In these embodiments, the second flow path B acts as a bypass for fluid directed to the outlet 90.

With reference to FIG. 5, when the nozzle insert 100 is in the second position, the tapered end portion 135 is spaced from the interior wall 160 to permit fluid flow from the outlet chamber 150 through the outlet 90 in addition to fluid flow along path A through the first outlet orifice 140 to the outlet 90. In the illustrated embodiment, the second position of the nozzle insert 100 provides a flow rate through the nozzle 25 between approximately 50 liters per minute and approximately 200 liters per minute, although other flow rates inside or outside this range can be achieved by the nozzle 25.

The upper housing portion 45 and the nozzle insert 100 are spaced apart from each other to define a gap or space 185 located between the flange 117 and the annular wall 165. Seals 190 are coupled to each of the flange 117 and the annular wall 115 to prevent fluid leakage between the gap 185 and the remainder the interior of the housing 40. With reference to FIGS. 3-5, a port 195 extends through the wall of the upper housing portion 45 to fluidly couple the gap 185 to a source of actuating fluid 200 (see FIG. 1). Generally, the actuating fluid is operable to move the nozzle insert 100 against the bias force to the second position. In the illustrated embodiment, the actuating fluid is pressurized or compressed air, although the actuating fluid can be a hydraulic fluid (water, etc.), or any other fluid suitable for actuating the nozzle insert 100 as described below. One or more valves (e.g., membrane valves, butterfly valves, etc.) or fittings can be positioned between the port 195 and the actuating fluid source 200 to selectively control flow of actuating fluid relative to the gap 185. In some embodiments, the nozzle 25 can include an electronic or electromagnetic actuator (e.g., a solenoid) in lieu of an actuating fluid to move the nozzle insert 100 from the first position to the second position.

In operation, the nozzle 25 is biased to the first position corresponding to the low flow state. With reference to FIG. 4, the nozzle insert 100 is in the first position such that the tapered end portion 135 is engaged with and substantially or completely seals against the interior wall 160 of the lower housing portion 50 to prevent fluid flow along the second flow path B. In the first position, fluid flows from the fluid source 15 into the nozzle 25 at a generally constant flow rate and exits the nozzle insert 100 along the first flow path A through the first outlet orifice 140.

Referring to FIGS. 4 and 5, the nozzle insert 100 can be adjusted to the second position by introducing actuating fluid into the gap 185. Buildup of actuating fluid in the gap 185, or simply the pressure of the actuating fluid acting on the flange 117, provides an upward force (as viewed in FIGS. 4 and 5) that eventually overcomes the downward bias force acting on the nozzle insert 100. When the upward force becomes larger than the downward bias force, the nozzle insert 100 moves to the second position as illustrated in FIG. 5. As illustrated, the nozzle insert 100 is pneumatically actuated by compressed air introduced into the gap 185 via the port 195. The flow of compressed air (or other actuating fluid) can be triggered automatically or remotely via a control system (not shown), or the flow of actuating fluid can be triggered manually (e.g., by opening a valve downstream of the source 200). When the force exerted by the compressed air acting on the surface area of the cylindrical wall 117 overcomes the biasing force of the bias element 175, the nozzle insert 100 slides upwardly to the second position (FIG. 5).

In the second position, which corresponds to the high flow state of the nozzle 25, the tapered end portion 135 of the nozzle insert 100 is spaced from the interior wall 160 due to upward movement of the nozzle insert 100. Fluid that may have accumulated in the outlet chamber 150 above the tapered end portion 135 flows downward through the outlet 90. As shown in FIG. 5, fluid flowing through the nozzle insert 100 in the high flow state is directed through the first outlet orifice 140 and the second outlet orifice 155 (through the openings 156) along flow paths A, B before the fluid is combined in the outlet chamber 150 and discharged through the outlet 90.

FIGS. 6-9 illustrate another nozzle 525 embodying aspects of the invention. Except as described below, the nozzle 525 is the same as the nozzle 25 described with regard to FIGS. 1-5, with like elements given the same reference numerals. Accordingly, the following description focuses primarily upon the structure and features that are different than the embodiment described in connection with FIGS. 1-5. In addition, the elements of the nozzle 525 that are the same as or similar to elements of the nozzle 25 described with regard to FIGS. 1-5 are given a reference numeral based on the reference numerals for FIGS. 1-5 plus 500.

Figure 6:
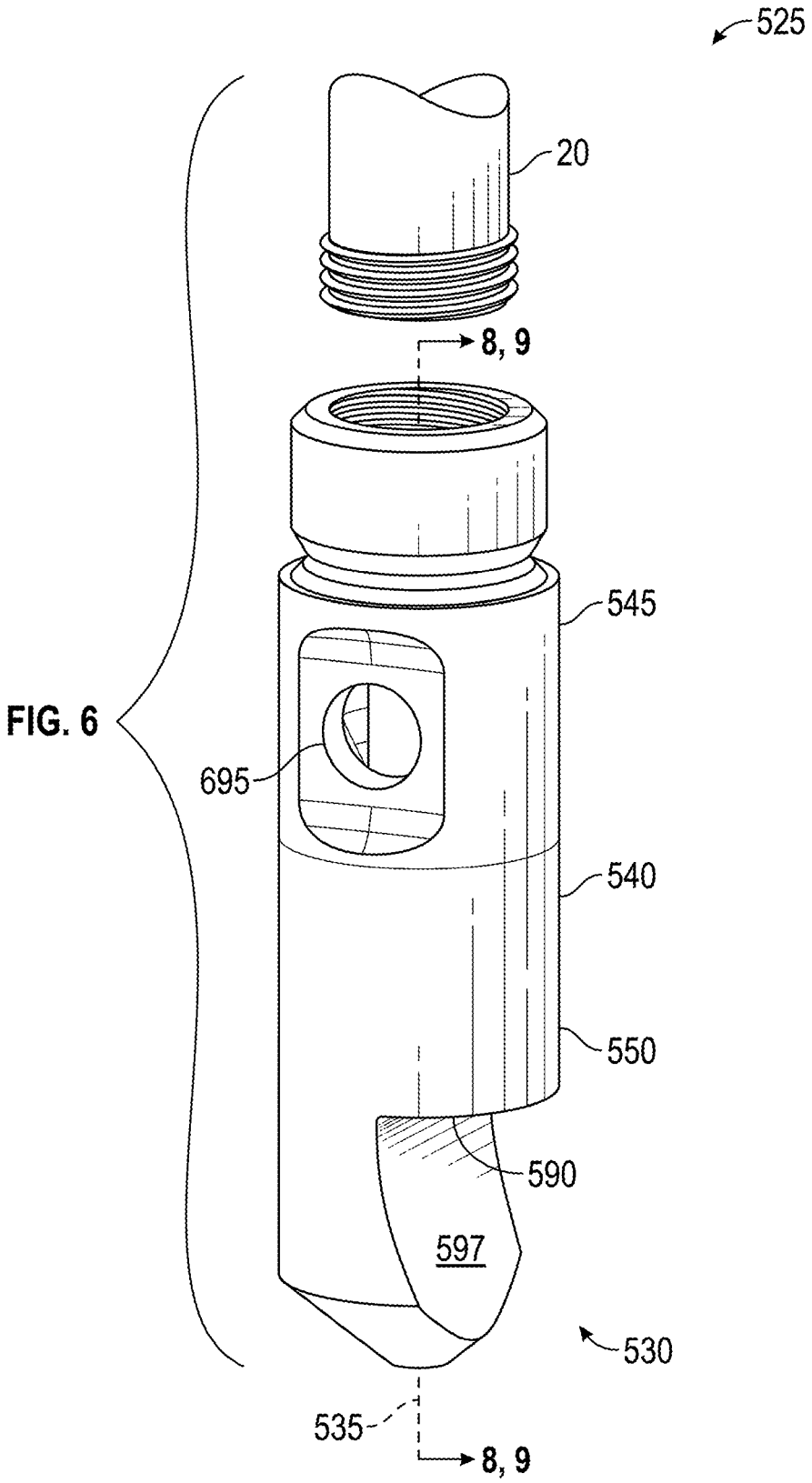
FIG. 6 is a perspective view of another nozzle embodying the invention.
Figure 7:
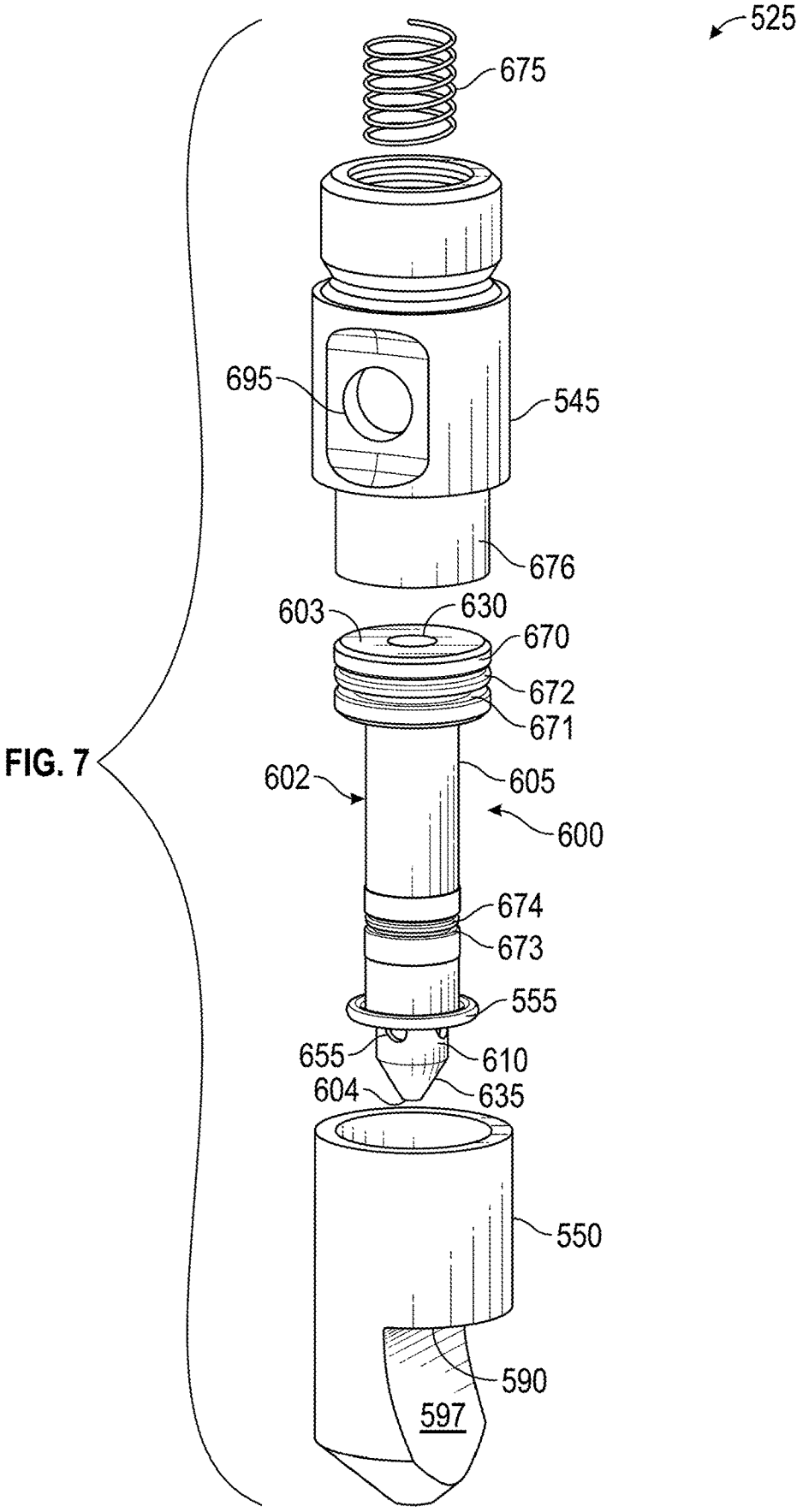
FIG. 7 is an exploded view of the nozzle of FIG. 6.

With reference to FIG. 6, the nozzle 525 includes a housing 540 that has an upper housing portion 545 and a lower housing portion 550. An O-ring 555 is located at an interface between the upper and lower housing portions 545, 555 to create a substantially fluid-tight seal between the housing portions 545, 555 (FIG. 7). As illustrated, nozzle 525 is removably coupled (e.g., by a threaded connection, a clamp connection, bolted connection, etc.) to one of the pipelines 20 of the fluid dispensing system 10 (see FIG. 1).

With continued reference to FIG. 6, the upper housing portion 545 receives a flow of fluid from the pipeline 20, and the lower housing portion 550 includes an outlet 590 to discharge the fluid to the surrounding environment 530. A scoop-like deflecting surface 597 is positioned adjacent the outlet 590 for directing the flow of fluid from the nozzle 525. In other embodiments, the nozzle 525 can have a variety of geometries to produce any particular spray pattern.

With reference to FIG. 7, the nozzle 525 includes a nozzle insert 600 to selectively control the flow of fluid through the nozzle 525. That is, like the nozzle insert 100, the nozzle insert 600 is movable to control the rate at which fluid is discharged through the outlet 590. The nozzle insert 600 includes an elongated body 602 that has a first end 603 and a second end 604 opposite the first end 603. In the illustrated embodiment, a generally cylindrical upper section 605 extends from the first end 603 (downward as illustrated in FIG. 7), and a lower section 610 extends from the second end 604.

Figure 9:
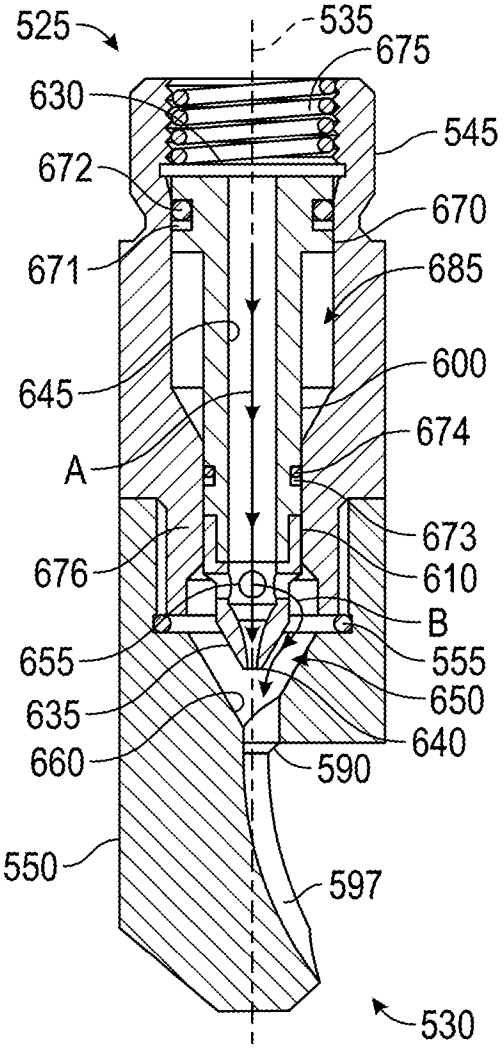
FIG. 9 is a cross-sectional view of the nozzle of FIG. 6, taken along line 9-9 and illustrating the nozzle in a high flow state.
Figure 8:
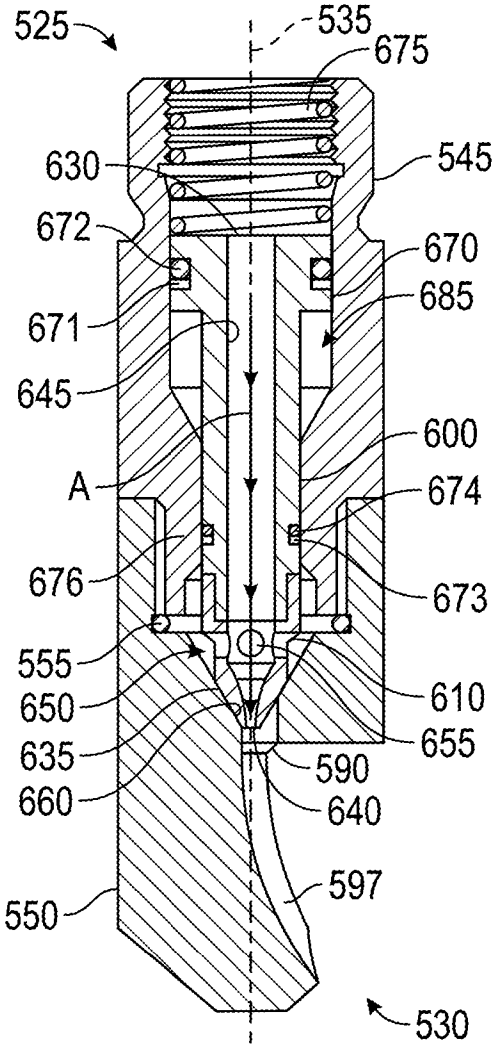
FIG. 8 is a cross-sectional view of the nozzle of FIG. 6, taken along line 8-8 and illustrating the nozzle in a low flow state.

Referring to FIGS. 8 and 9, the nozzle insert 600 is selectively movable relative to the housing between a first position (FIG. 8) corresponding to a low flow state of the nozzle 525 and a second position (FIG. 9) corresponding to a high flow state of the nozzle 525. The first end 603 of the nozzle insert 600 defines an inlet 630 in fluid communication with the fluid source 15 to receive a flow of fluid, and the second end 604 defines a first outlet orifice 640 in fluid communication with the outlet 590 to direct fluid from the inlet 630 toward the outlet 590. An elongated central bore 645 extends longitudinally through the body 602, from the inlet 630 to the first outlet orifice 640, to define a first fluid flow path A between the inlet 630 and the first outlet orifice 640.

With reference to FIG. 8, when the nozzle insert 600 is in the first position, a tapered end portion 635 adjacent the second end 604 of the nozzle insert 600 bears against or engages an interior wall 660 of the lower housing portion 550 to form a seal that prevents fluid in the outlet chamber 650 from being discharged through the outlet 590. As such, all of the fluid flowing through the nozzle insert 600 flows through the first outlet orifice 640 along the first flow path A. In the illustrated embodiment, the low flow state provides a flow rate through the nozzle 525 between approximately 0.1 liters per minute and approximately 3 liters per minute, although the nozzle 525 can be constructed to provide other flow rates in the low flow state to suit a particular application. In addition, the outlet orifice 640 of the nozzle insert 600 can be plugged or omitted such there is no fluid flow through the nozzle 525 in the low flow state.

The lower housing portion 550 defines an outlet chamber 650 adjacent the outlet 590 that surrounds the lower section 610 of the nozzle insert 600. A second outlet orifice 655, defined by a plurality of openings 656 extending through the body 602, defines a second flow path B that allows fluid to flow out of the nozzle insert 600 and into the outlet chamber 650, bypassing the relatively restrictive first outlet orifice 640.

When the nozzle insert 600 is in the second position (FIG. 9), the tapered end portion 635 is spaced from the interior wall 660 to permit fluid flow from the outlet chamber 650 through the outlet 590. Fluid flowing through the nozzle insert 600 can flow into the outlet chamber 650 through the first outlet orifice 640 and the second outlet orifice 655 before being discharged through the outlet 590. That is, fluid is directed through the nozzle insert 600 along the first flow path A and the second flow path B. In the illustrated embodiment, the high flow state provides a flow rate through the nozzle 525 between approximately 3 liters per minute and approximately 15 liters per minute. In other constructions, the nozzle 525 can be constructed to provide other flow rates in the high flow state to suit a particular application.

The upper section 605 of the nozzle insert 600 includes an annular flange 670 located adjacent the inlet 630. The illustrated nozzle 525 includes a bias element 675 (e.g., a coil spring) that acts on the first end 603 of the nozzle insert 600 to bias the nozzle insert 600 toward the first position. In some constructions, the flow of fluid into the nozzle insert 600 may be sufficient to bias the nozzle insert 600 to the first position without the bias element 675.

The flange 670 includes a first circumferential groove 671 that receives an O-ring 672 to provide a generally fluid-tight seal between the flange 670 and the interior of the upper housing portion 545. The upper housing portion 545 and the nozzle insert 600 are spaced apart from each other to define a gap or space 685 located between the flange 670 and the lower end of the upper housing portion 545. The nozzle insert 600 has a second circumferential groove 673 located on the cylindrical section 605 adjacent the lower end of the upper housing portion 545 and receives an O-ring 674 to generate a fluid-tight seal between the nozzle insert 600 and the lower end of the upper housing portion 545. With reference to FIGS. 7-9, a port 695 extends through the wall of the upper housing portion 545 to fluidly couple the gap 685 to the source of actuating fluid 200 (FIG. 1).

Generally, the nozzle 525 is operated in substantially the same manner as the nozzle 25 described with regard to FIGS. 1-5 to provide low and high fluid flow rates through the nozzle 525. More specifically, the nozzle 525 is biased to the first position corresponding to the low flow state so that fluid only flows along the first flow path A. The nozzle insert 600 can be adjusted to the second position by introducing actuating fluid into the gap 685. Buildup of actuating fluid in the gap 685, or simply the pressure of the actuating fluid acting on the flange 670, provides an upward force (as viewed in FIGS. 8 and 9) that eventually overcomes the downward bias force acting on the nozzle insert 600. When the upward force becomes larger than the downward bias force, the nozzle insert 600 moves to the second position as illustrated in FIG. 9. As illustrated, the nozzle insert 600 is pneumatically actuated by compressed air introduced into the gap 685 via the port 695. When the force exerted by the compressed air acting on the surface area of the cylindrical wall 670 overcomes the biasing force of the bias element 675, the nozzle insert 600 slides upwardly to the second position (FIG. 9).

In the second position, which corresponds to the high flow state of the nozzle 525, the tapered end portion 635 of the nozzle insert 600 is spaced from the interior wall 660 due to upward movement of the nozzle insert 600. Fluid that may have accumulated in the outlet chamber 650 above the tapered end portion 635 flows downward through the outlet 590. As shown in FIG. 9, fluid flowing through the nozzle insert 600 in the high flow state is directed through the first outlet orifice 640 and the second outlet orifice 655 along the flow paths A, B before the fluid is combined in the outlet chamber 650 and discharged through the outlet 590.

Because the nozzles 25, 525 are operable in the low flow state and the high flow state independent of the velocity of fluid entering the nozzle 25, 525, the nozzle 25, 525 can be predictably operated at the desired flow rate regardless of the inlet fluid velocity. That is, the discharge fluid velocity at the outlet 90, 590 can be maintained within the desired range even if the velocity of fluid entering the nozzle fluctuates any amount.

Various features of the invention are set forth in the following claims.

The invention claimed is:

1. A fluid dispensing nozzle comprising:

a housing including an outlet to discharge fluid to a surrounding environment; and a nozzle insert disposed in the housing and including an inlet in fluid communication with a source of fluid to receive a fluid flow, a first outlet orifice and a second outlet orifice positioned upstream from the first outlet orifice, wherein the nozzle insert is selectively movable relative to the housing between a first position in which fluid from the inlet is discharged through the outlet at a first flow rate, and a second position in which the fluid from the inlet is discharged through the outlet at a second flow rate larger than the first flow rate, the nozzle insert movable between the first position and the second position independent of the pressure of fluid at the inlet, wherein the first outlet orifice is in fluid communication with the outlet in the first position and the second position, and wherein the second outlet orifice is separately in selective fluid communication with the outlet only in the second position.

2. The fluid dispensing nozzle of claim 1, wherein the nozzle insert is movable between the first position and the second position in response to an actuating fluid introduced into the housing.

3. The fluid dispensing nozzle of claim 2, wherein the housing and the nozzle insert cooperatively define a gap, and wherein the actuating fluid is introduced into the gap.

4. The fluid dispensing nozzle of claim 3, wherein the nozzle insert has a flange positioned adjacent the inlet, and wherein the actuating fluid acts upon the flange to move the nozzle insert between the first position and the second position.

5. The fluid dispensing nozzle of claim 1, further comprising a bias element coupled to the nozzle insert to bias the nozzle insert toward the first position.

6. The fluid dispensing nozzle of claim 1, wherein the nozzle insert has a central bore extending from the inlet to the first outlet orifice to define a first flow path through the nozzle insert, and the second outlet orifice defines a second flow path different from the first flow path.

7. The fluid dispensing nozzle of claim 6, wherein the second outlet orifice is defined by a plurality of openings.

8. The fluid dispensing nozzle of claim 6, wherein the housing defines an outlet chamber adjacent the outlet, wherein in the first position, fluid is directed along the first flow path through the outlet, and wherein in the second position, fluid is directed along the first flow path and the second flow path through the outlet.

9. The fluid dispensing nozzle of claim 8, wherein in the first position, an end of the nozzle insert disposed adjacent the first outlet orifice is positioned to contact an interior wall of the housing to impede fluid flow along the second flow path to the outlet.

10. The fluid dispensing nozzle of claim 9, wherein the end of the nozzle insert is spaced from the interior wall when the nozzle insert is in the second position to permit fluid flow along the second flow path to the outlet.

11. A fluid dispensing nozzle comprising:

a housing defining an outlet; and a nozzle insert disposed in the housing and including an inlet positioned to receive a flow of fluid from a fluid source, the nozzle insert selectively movable relative to the housing between a first position in which fluid from the inlet is discharged through the outlet at a first flow rate and a second position in which fluid from the inlet is discharged through the outlet at a second flow rate larger than the first flow rate independent of the pressure of fluid at the inlet, the nozzle insert further including a first outlet orifice in fluid communication with the inlet to discharge fluid from the nozzle insert toward the outlet, and a second outlet orifice positioned upstream of the first outlet orifice and in fluid communication with the inlet to discharge fluid from the nozzle insert, the second outlet orifice separately in selective fluid communication with the outlet, wherein fluid is configured to be discharged from the nozzle insert to the outlet only through the first outlet orifice when the nozzle insert is in the first position, and wherein fluid is configured to be discharged from the nozzle insert to the outlet through the first outlet orifice and the second outlet orifice when the nozzle insert is in the second position.

12. The fluid dispensing nozzle of claim 11, wherein nozzle insert is defined by an elongated body having a first end defining the inlet and a second end defining the first outlet orifice, and wherein the second outlet orifice is defined in a wall of the elongated body between the first end and the second end.

13. The fluid dispensing nozzle of claim 12, wherein in the first position, the second end of the nozzle insert is positioned to contact an interior wall of the housing to impede fluid flow from the second outlet orifice to the outlet.

14. The fluid dispensing nozzle of claim 13, wherein in the second position, the second end of the nozzle insert is spaced from the interior wall to permit fluid flow from the second outlet orifice to the outlet.

15. The fluid dispensing nozzle of claim 11, wherein the nozzle insert is movable between the first position and the second position in response to an actuating fluid introduced into the housing.

16. The fluid dispensing nozzle of claim 15, wherein the housing and the nozzle insert cooperatively define a gap, and wherein the actuating fluid is introduced into the gap.

17. The fluid dispensing nozzle of claim 16, wherein the nozzle insert has a flange positioned adjacent the inlet, and wherein the actuating fluid acts upon the flange to move the nozzle insert between the first position and the second position.

18. A fluid dispensing system comprising:

a fluid source;

a pipeline coupled to the fluid source and extending from the fluid source to convey fluid from the fluid source;

a nozzle coupled to the pipeline, the nozzle including a housing coupled to the pipeline and including an outlet to discharge fluid from the pipeline to a surrounding environment, a nozzle insert disposed in the housing and defining an inlet and a first outlet orifice arranged to dispense fluid from the nozzle insert along a longitudinal axis, the nozzle insert further defining a second outlet orifice positioned upstream of the first outlet orifice, the nozzle insert selectively movable relative to the housing between a first position in which fluid is discharged through the nozzle insert and the outlet at a first flow rate and a second position in which fluid is discharged through the nozzle insert and the outlet at a second flow rate larger than the first flow rate, wherein the nozzle insert movable between the first position and the second position independent of the pressure of fluid at the inlet, wherein the first outlet orifice is in fluid communication with the outlet in the first position and the second position, and wherein the second outlet orifice is separately in selective fluid communication with the outlet only in the second position, wherein the housing and the nozzle insert cooperatively define a gap, and the housing includes a port in communication with the gap and further adapted to be in communication with a source of actuating fluid to selectively vary the position of the nozzle insert within the housing to adjust the flow rate of fluid discharged from the outlet, and wherein a flow rate of fluid entering the nozzle insert through the inlet is substantially constant in the first position and the second position.

19. The fluid dispensing system of claim 18, wherein the inlet is in fluid communication with the pipeline and an elongated bore extends from the inlet to the outlet orifice to direct fluid through the nozzle insert.

20. The fluid dispensing system of claim 19, wherein the housing defines an outlet chamber adjacent the outlet, wherein in the first position, fluid is directed along a first flow path through the outlet, and wherein in the second position, fluid is directed along the first flow path and a second flow path through the outlet.

21. The fluid dispensing nozzle of claim 19, wherein in the first position, an end of the nozzle insert disposed adjacent the first outlet orifice is positioned to contact an interior wall of the housing to impede fluid flow along the second flow path to the outlet.

22. The fluid dispensing nozzle of claim 21, wherein the end of the nozzle insert is spaced from the interior wall when the nozzle insert is in the second position to permit fluid flow along the second flow path to the outlet.

23. A method of changing a flow rate of a fluid through a dispensing nozzle, the method comprising:

directing a fluid into an inlet of a nozzle insert supported by a housing, the inlet in fluid communication with a source of fluid;

discharging fluid through the nozzle insert along a first flow path through a first outlet orifice to an outlet for discharge to a surrounding environment when the nozzle insert is in a first position;

inhibiting fluid flow through the nozzle insert along a second flow path while the nozzle insert is in the first position;

dispensing fluid from the outlet at a first flow rate;

selectively adjusting the nozzle insert relative to the housing to a second position;

discharging fluid through the nozzle insert along the first flow path through the first outlet orifice and the second flow path through a second outlet orifice in response to movement of the nozzle insert relative to the housing, the second outlet orifice positioned upstream from the first outlet orifice and separately in selective fluid communication with the outlet only in the second position;

dispensing fluid from the nozzle at a second flow rate that is larger than the first flow rate;

moving the nozzle insert between the first position and the second position independent of the pressure of fluid entering the nozzle.

24. The method of claim 23, further comprising directing an actuating fluid into the housing;

moving the nozzle insert from the first position to the second position within the housing in response to directing the actuating fluid into the housing; and biasing the nozzle insert toward the first position.

* * * * *